US006492796B1

(12) United States Patent
Morley

(10) Patent No.: US 6,492,796 B1
(45) Date of Patent: Dec. 10, 2002

(54) CURRENT MIRROR HAVING IMPROVED POWER SUPPLY REJECTION

(75) Inventor: Sean Morley, Co. Limerick (IE)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 09/887,645

(22) Filed: Jun. 22, 2001

(51) Int. Cl.[7] ..... G05F 3/16
(52) U.S. Cl. ..... 323/316
(58) Field of Search ..... 323/315, 316, 323/317; 327/535, 538, 539

(56) References Cited

U.S. PATENT DOCUMENTS 4,471,292 A * 9/1984 Schenck et al. ..... 323/315
5,107,199 A * 4/1992 Vo et al. ..... 323/316
5,136,293 A * 8/1992 Matsuo et al. ..... 341/144
5,485,074 A 1/1996 Tomasini et al.
5,512,816 A 4/1996 Lambert
5,625,281 A 4/1997 Lambert
5,646,518 A * 7/1997 Lakshmikumar et al. ... 323/316
5,955,915 A * 9/1999 Edwards ..... 327/541

OTHER PUBLICATIONS

Horenstein, Mark N., "Microelecronic Circuits and Devices," Second Edition, 1996 by Prentice Hall, Englewood Cliffs, New Jersey, pp. 256, 273, 502 and 503.

* cited by examiner

*Primary Examiner*—Matthew Nguyen
(74) *Attorney, Agent, or Firm*—Wolf, Greenfield & Sacks, P.C.

(57) ABSTRACT

A circuit comprises a current source providing an input current, first and second transistors having common control terminals and forming a current mirror connected between first and second power supply potentials, with the first transistor having an input coupled to the current source, the current mirror generating a mirror current at an output of the second transistor, and an amplifier connected in a negative feedback loop around the first transistor, wherein the amplifier input is referenced to the first power supply potential, and the amplifier output is referenced to the second power supply potential. A method for improving power supply rejection ratio of a current mirror is also described.

21 Claims, 6 Drawing Sheets

CURRENT MIRROR HAVING IMPROVED POWER SUPPLY REJECTION

FIELD OF THE INVENTION

This invention relates generally to electronic circuits and in particular to an electronic circuit configured as a current mirror, and is more particularly directed toward a current mirror having improved power supply rejection.

BACKGROUND OF THE INVENTION

A current mirror is a current-controlled current source that ideally provides an output current that is constant for a given input current. Current mirror circuits are particularly useful in integrated circuit implementations of operational amplifiers, to establish the DC operating point (or bias condition) for the circuit. Using current mirrors, the output of a current source can be replicated where needed throughout a given circuit.

FIG. 1 depicts a simple current mirror, generally depicted by the numeral 100. Input current for the current mirror 100 is provided by a current source Iin 101, which has an output impedance represented by parallel resistor Ri 102. The connection 105 between the gate 103 and drain 104 of PMOS transistor MP1 106 establishes the required gate-source voltage, Vgs, to carry the input current in transistor MP1 106. MP2 replicates the input current 101 to the output Iout 108, since MP1 and MP2 have the same gate-source voltage Vgs. In an integrated circuit (IC) implementation, the ratio of Iout to Iin can be set by the ratio of the areas of MP2 to MP1.

If a disturbance voltage is added to the supply voltage $V_{DD}$ 109, an unwanted current will flow in the output Iout 108. Power supply rejection is the ability of the circuit 100 to minimize the unwanted current in the output Iout 108 in the presence of a disturbance on $V_{DD}$ 109.

A number of techniques have been proposed in an effort to improve the power supply rejection ratio (PSRR) of a current mirror. In U.S. Pat. No. 4,471,292, Schenck et al. propose operating the mirror transistors in their saturation region at an operating point that is close to the boundary between linearity and saturation. The point where Schenck et al. bias the transistors is optimized so that the current mirror occupies the minimum amount of headroom. This is at the expense of lower output impedance and PSRR. FIG. 2 of Schenck et al. shows that the output impedance degrades rapidly if $V_{DS}$ is slightly reduced. Random mismatches in device sizes may lead the circuit to operate in this undesired region. Essentially, Schenck et al. are biasing the circuit for minimum headroom at the expense of lower output impedance and PSRR and the risk of these parameters being degraded further. In addition, the technique described does not correct for unwanted current flowing in the output impedance of the input current source.

Tomasini et al., in U.S. Pat. No. 5,485,074, increase PSRR by cascoding the output transistor of the current mirror. However, it is known that cascoding results in higher operating voltage requirements for the current mirror, and may limit the range of circuits with which the current mirror can be employed without interposing level translation circuitry. Operating voltage margin is often expressed in terms of "headroom," which is the difference between the supply voltage and the required operating voltage.

Lambert, in U.S. Pat. No. 5,512,816, proposes to improve power supply rejection ratio by generating an error current that tracks power supply variations, then replicating the error current into a summing circuit that cancels out its effect. This method displays sensitivity to mismatch errors. $I_{err}$ is a small current, and it is sensitive to errors in current mirror 208 (FIG. 2 of Lambert) that subtracts it from the output. Mismatch error is caused by random area mismatches between two transistors that ideally should be the same size. Lambert does manage to correct for unwanted current that flows in the output impedance of Q203 due to $V_{DD}$ variations. In the circuit of FIG. 2, the input current can be a current source as shown, or a current sink connected to point 214. Another disadvantage of this circuit is that a correction current has to be subtracted from each replica of the input.

This disadvantage in particular is addressed in a modification of this technique set forth in U.S. Pat. No. 5,625,281, an op-amp loop to track the reference current in order to eliminate the need for error-subtraction at every current mirror output. However, this modified technique does not correct for unwanted current that flows in the output impedance of the input current source. This is because the circuit configuration requires that the input be a current source. The output impedance of the input current source is connected between $V_{DD}$ and a ground-referenced node, and hence will have an unwanted current flowing through it. This current is replicated to the output.

Because of the above-described shortcomings of prior art techniques, a need arises for a current mirror having improved power supply rejection that is relatively simple and economical in implementation, offers reduced sensitivity to mismatch errors, and minimizes supply voltage concerns related to headroom requirements.

SUMMARY OF THE INVENTION

These needs and others are satisfied by the present invention. In accordance with one aspect of the invention, a circuit comprises a current source providing an input current, first and second transistors having common control terminals and forming a current mirror connected between first and second power supply potentials, with the first transistor having an input coupled to the current source, the current mirror generating a mirror current at an output of the second transistor, and an amplifier connected in a negative feedback loop around the first transistor, wherein the amplifier input is referenced to the first power supply potential, and the amplifier output is referenced to the second power supply potential. The first and second transistors may comprise MOS transistors, with the common control terminals of the first and second transistors comprising common source terminals and common gate terminals.

In one form of the invention, the input current source is connected in series with the first transistor drain terminal, defining an amplifier input node therebetween. The amplifier output is then coupled to the common gate terminals of the first and second transistors. The first supply potential may be ground potential, while the second supply potential may be a positive power supply voltage coupled to the common source terminals of the first and second transistors.

In another form of the invention, the amplifier comprises an input stage including third and fourth transistors configured as a parallel transistor pair connected in series with a fifth transistor configured as a current source, and an output stage comprising a sixth transistor coupled to the input stage and in series with a diode-connected output transistor. The third and fourth transistors may be MOS transistors. The amplifier input signal may be applied to the gate terminal of the third transistor.

In still another form of the invention, the third and fourth transistors have common source terminals each coupled to the first power supply potential, and common drain terminals each coupled to the fifth transistor configured as a current source. A bias potential may be applied to a gate terminal of the fifth transistor to establish fifth transistor operating current. The bias potential is derived from the second power supply potential such that variations in the second power supply potential appear in the bias potential.

In still a further form of the invention, a gate terminal of the fourth transistor is coupled to the common drain terminals of the third and fourth transistors, the gate terminal defining both an output of the first amplifier stage and an input of the second amplifier stage. The sixth transistor further includes a source terminal coupled to the first power supply potential and a drain terminal coupled to common drain and gate terminals of the seventh diode-connected transistor. The seventh diode-connected transistor includes a source terminal coupled to the second power supply potential, wherein the common drain and gate terminals are coupled to the common gate terminals shared by the first and second transistors of the current mirror.

In accordance with another aspect of the invention, the amplifier comprises a single stage differential amplifier including third and fourth transistors configured as a differential transistor pair and sharing common source terminals, a current source interposed between the common source terminals and the first power supply potential, a fifth diode-connected transistor coupled between a drain terminal of the third transistor and the second power supply potential, a sixth diode-connected transistor coupled between a drain terminal of the fourth transistor and the second power supply potential, the sixth transistor having gate and drain electrodes connected together and coupled to the common gate terminals of the first and second transistors.

In accordance with a further aspect of the invention, a method is provided for improving power supply rejection ratio of a current mirror including first and second transistors having common control terminals and forming a current mirror connected between first and second power supply potentials, with the first transistor having an input coupled to an input current source, and the current mirror generating a mirror current at an output of the second transistor. The method comprises the steps of providing an amplifier in a negative feedback loop around the first transistor, configuring the amplifier such that the amplifier input is referenced to the first power supply potential, and configuring the amplifier such that the amplifier output is referenced to the second power supply potential. The negative feedback establishes a control voltage at one of the common control terminals to maintain substantial equality between the input current and the mirror current.

In accordance with yet a further aspect of the invention, a circuit comprises a current source providing an input current, first and second transconductors having common control terminals and forming a current mirror connected between first and second power supply potentials, with the first transconductor having an input coupled to the current source, the current mirror generating a mirror current at an output of the second transconductor, and an amplifier connected in a negative feedback loop around the first transconductor, wherein the amplifier input is referenced to the first power supply potential, and the amplifier output is referenced to the second power supply potential. The transconductors may comprise single transistors or cascoded transistors.

Further objects, features, and advantages of the present invention will become apparent from the following description and drawings.

DETAILED DESCRIPTION OF THE INVENTION

There is described herein an improved power supply rejection current mirror that offers distinct advantages when compared to the prior art.

Figure 1:
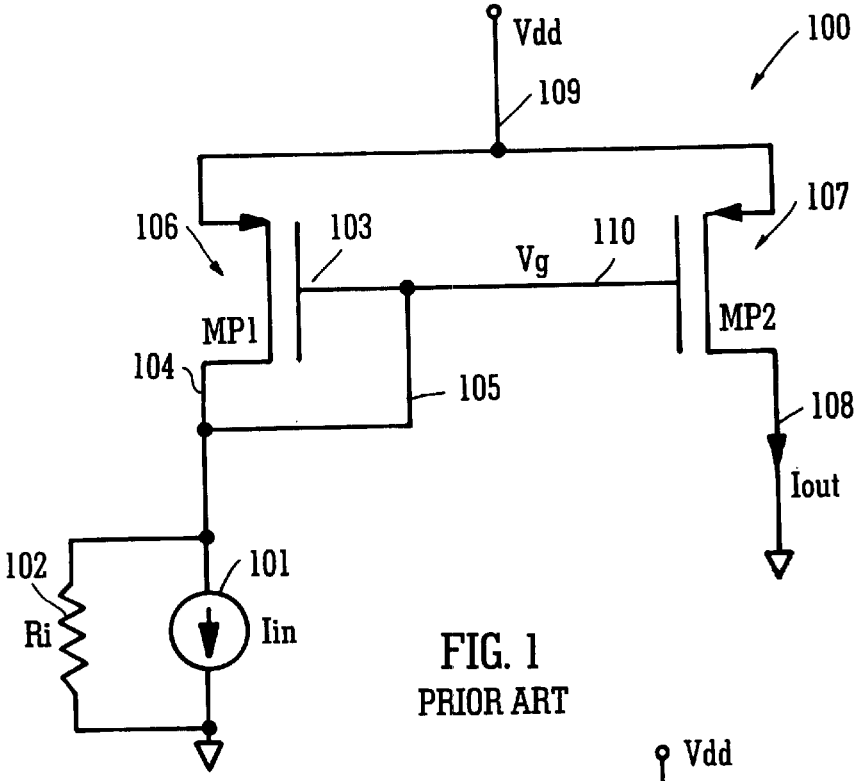
FIG. 1 PRIOR ART
FIG. 1 depicts a simple current mirror as known in the art.

Small signal analysis of the circuit 100 of FIG. 1 yields the result:

$$iout = vdd/Ri + vdd/Ro2 \quad \text{(equation 1)}$$

Where vdd represents the amplitude of the disturbance on $V_{DD}$, iout represents the unwanted current in the output Iout, Ri represents the output impedance of the input current source Iin 101, and Ro2 represents the output impedance of MP2 (not illustrated in FIG. 1).

This result can be explained intuitively as follows: the disturbance on $V_{DD}$ is replicated on Vg, the gate voltage of both transistors MP1 and MP2, since Vgs of MP1 is constant for a constant input current. Therefore a current will flow in Ri equal to vdd/Ri. This current will flow in MP1 and be mirrored to MP2, and therefore flow in the output Iout 108.

The disturbance vdd also appears across Ro2, the drain-source output impedance of MP2, since its source is connected to VDD and its drain is approximately at ground. Therefore, another unwanted current term flows in iout equal to vdd/Ro2. It can be appreciated therefore that one step to improve the supply rejection of the current mirror 100 is to increase the output impedance, Ro2.

Figure 2:
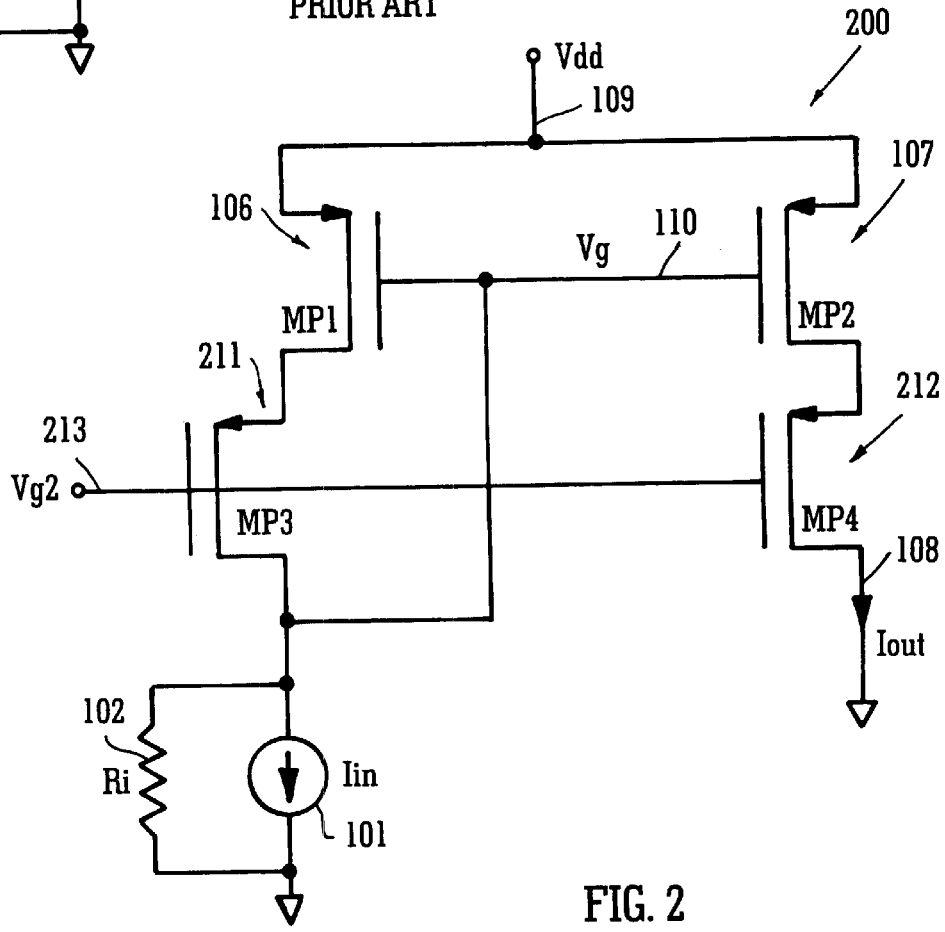
FIG. 2 PRIOR ART
FIG. 2 illustrates a cascoded current mirror of a type known in the art.

FIG. 2 illustrates a technique that is normally applied to achieve this. This technique is referred to as "cascading." In the current mirror circuit of FIG. 2, generally depicted by the numeral 200, transistors MP3 and MP4 211, 212 are placed in series with MP1 and MP2 106, 107, with the gates of MP3 and MP4 biased at an appropriate voltage Vg2 213. Small signal analysis yields the result that the output impedance is given by Ro2$*g_m$MP4/$g_o$MP4, where $g_m$MP4 is the small signal transconductance of transistor MP4 212, and $g_o$MP4 is the small signal output conductance of transistor MP4 212. The current source 101 that provides the input current Iin can also be cascoded to increase Ri 102, and thus further improve the supply rejection.

Figure 3:
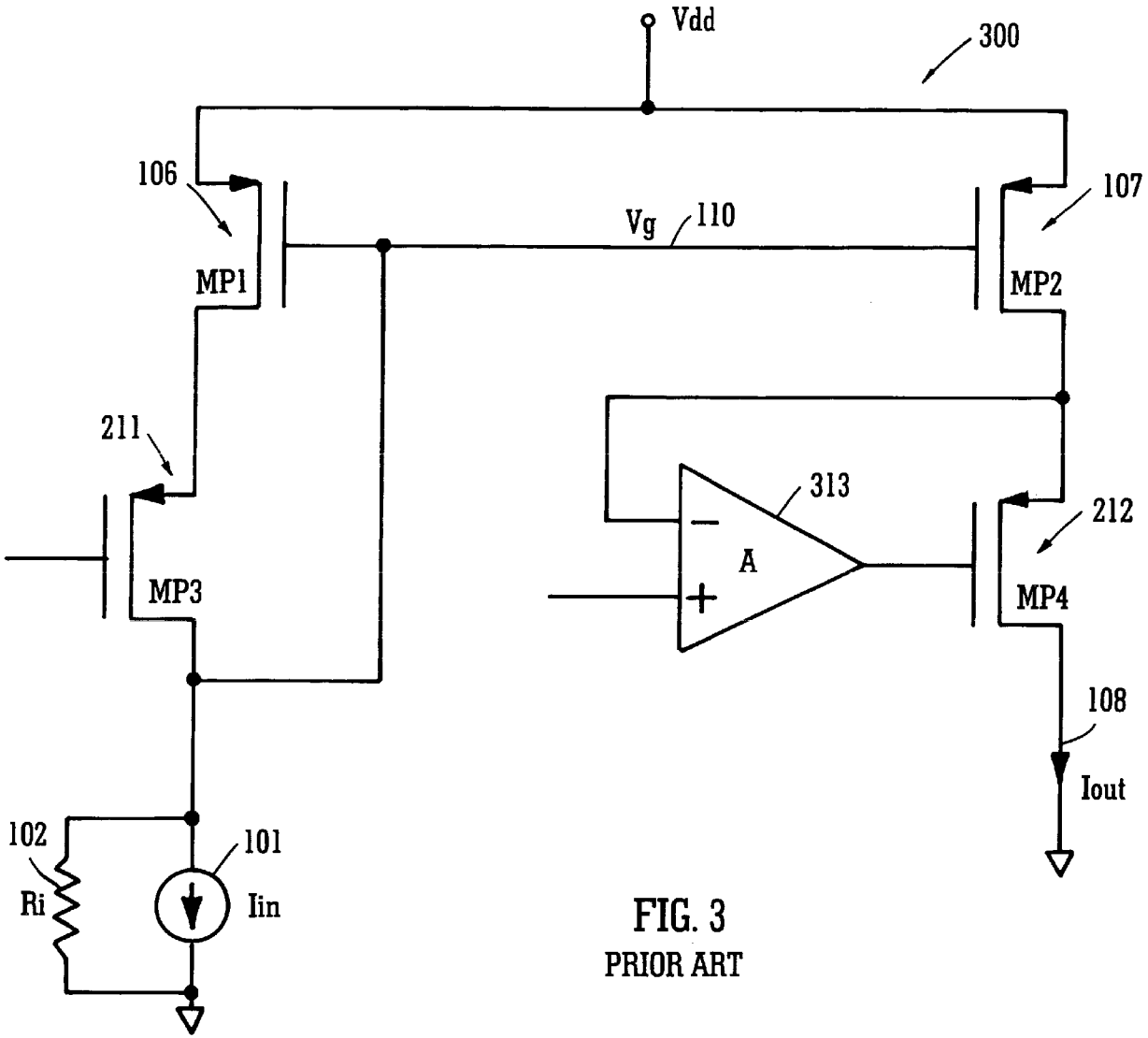
FIG. 3 PRIOR ART
FIG. 3 shows a cascoded current mirror including an amplifier to increase the gain of the cascode.

FIG. 3 depicts a current mirror 300 incorporating a further step to increase the output impedance. An amplifier 313 is placed in feedback around the cascode transistor MP4 212. This amplifier 313 increases the gain of the cascode, and hence the technique is referred to as "gain enhanced cascoding." For this circuit, the output impedance is Ro2*(A+1)$g_m$MP4/$g_o$MP4, where A is the gain of the amplifier 313, $g_m$MP4 is the small signal transconductance of transistor MP4, and $g_o$MP4 is the small signal output conductance of transistor MP4. Again, the input current source 101 can also have this technique applied to increase its output impedance.

Figure 4:
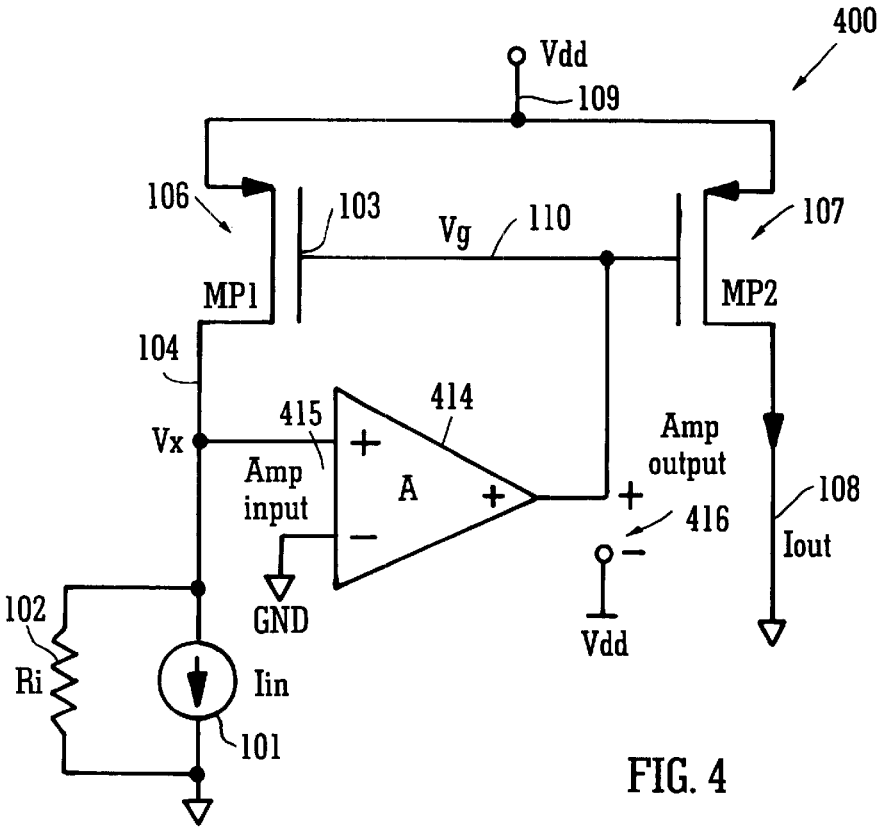
FIG. 4 depicts a current mirror circuit in accordance with one embodiment of the present invention.

FIG. 4 illustrates a current mirror circuit 400 in accordance with the present invention. The current mirror 400 differs from prior art current mirror 100 (FIG. 1) in that the connection between the gate 103 and drain 104 of MP1 106 is replaced by an amplifier 414 whose input 415 is referenced to ground and whose output 416 is referenced to $V_{DD}$.

The amplifier 414 can be described by the expression:

$$Vg-V_{DD}=A^*(V_X-0) \quad \text{(equation 2)}$$

The negative feedback loop around MP1 106 establishes the voltage Vg 110 such that Iout 108 is equal to Iin 101. In the presence of a disturbance on $V_{DD}$, $Vg-V_{DD}$ remains essentially constant to maintain the relationship Iout=Iin. Applying equation 1 shows that Vx remains constant (i.e., it does not follow any disturbance on $V_{DD}$). This result can be used to explain intuitively how the circuit 400 improves the power supply rejection of a current mirror.

First of all, no unwanted current flows in Ri 102 in the presence of a disturbance on $V_{DD}$, since Vx remains constant. This contrasts with the circuit 100 of FIG. 1, where a disturbance on $V_{DD}$ appears across Ri, producing an unwanted current variation in the input, and a corresponding variation in the output of the current mirror. This elimination of the unwanted current variation in Ri corresponds to a reduction of the first term of equation 1.

Second, the second term in equation 1 (vdd/Ro2) is also reduced. To explain this requires small signal analysis of the circuit 400.

Figure 5:
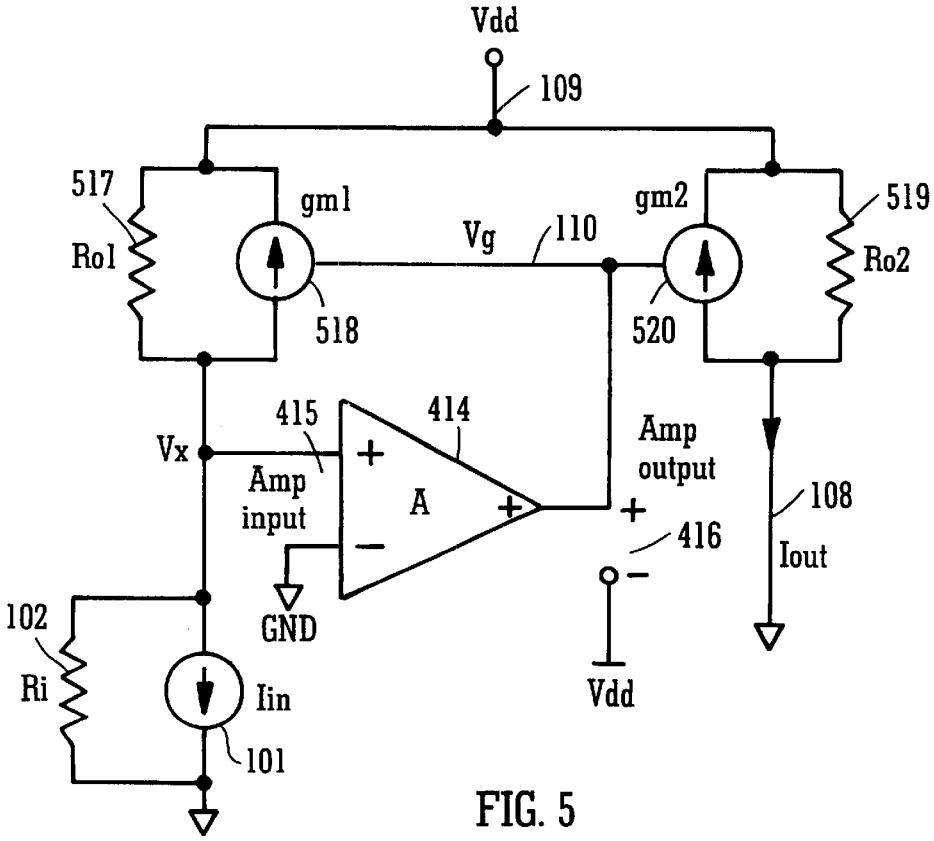
FIG. 5 shows the current mirror of FIG. 4 with the transistors replaced by their small signal models.

In FIG. 5, transistors MP1 and MP2 have been replaced by their small signal model, which consists of an output impedance (Ro) and a transconductance ($g_m$). The transconductance outputs a current proportional to Vgs, which in this case is $Vg-V_{DD}$. MP1 of FIG. 4 has been replaced by output impedance Ro1 517 and transconductance $g_m$1 518, while MP2 of FIG. 4 has been replaced by output impedance Ro2 519 and transconductance $g_m$2 520.

As noted above, there is no disturbance on Vx in the presence of a disturbance on $V_{DD}$, and hence no unwanted current flow in Ri 102. The disturbance on $V_{DD}$ (vdd) appears across Ro1 517, producing a current vdd/Ro1. Since the total current entering a node must equal the total current leaving the node, the sum of the currents in Ro1 and $g_m$1 equals Iin, which is constant. This implies that a current equal to −vdd/Ro1 must flow in $g_m$1. The negative feedback through the amplifier 414 ensures this condition. This current (−vdd/Ro1) is replicated in $g_m$2, since transistor MP2 (now replaced by its model) has the same Vgs as MP1.

The current in Ro2 519 is equal to vdd/Ro2, since vdd appears across Ro2. The total output current, Iout, in the presence of a disturbance on $V_{DD}$, is equal to vdd/Ro2−vdd/Ro1, which is zero since Ro1=Ro2. Thus, the addition of the amplifier 414 has removed both terms in equation 1.

The complete expression for the output current due to a disturbance on $V_{DD}$ is:

$$iout = vdd \times \frac{1}{Ro}\left[1 - \frac{g_m}{g_m + \frac{1}{Ro} + \frac{1}{Ri}}\right] \quad \text{(equation 3)}$$

Where $g_m=g_m1=g_m2$, and Ro=Ro1=Ro2, and A=1. Typically, gm>>1/Ro+1/Ri.

Applying this simplification yields the expression:

$$iout = vdd \times \frac{1}{Ro}\left[1 - \frac{g_m}{g_m}\right] = 0$$

This corresponds to the result of the intuitive analysis. It should be noted that transistors generally can also be characterized as "transconductors," and that current mirror transistors such as MP1 106 and MP2 107 (FIG. 4) could readily be replaced by cascoded transistors. These cascoded combinations are also accurately described as transconductors.

Figure 6:
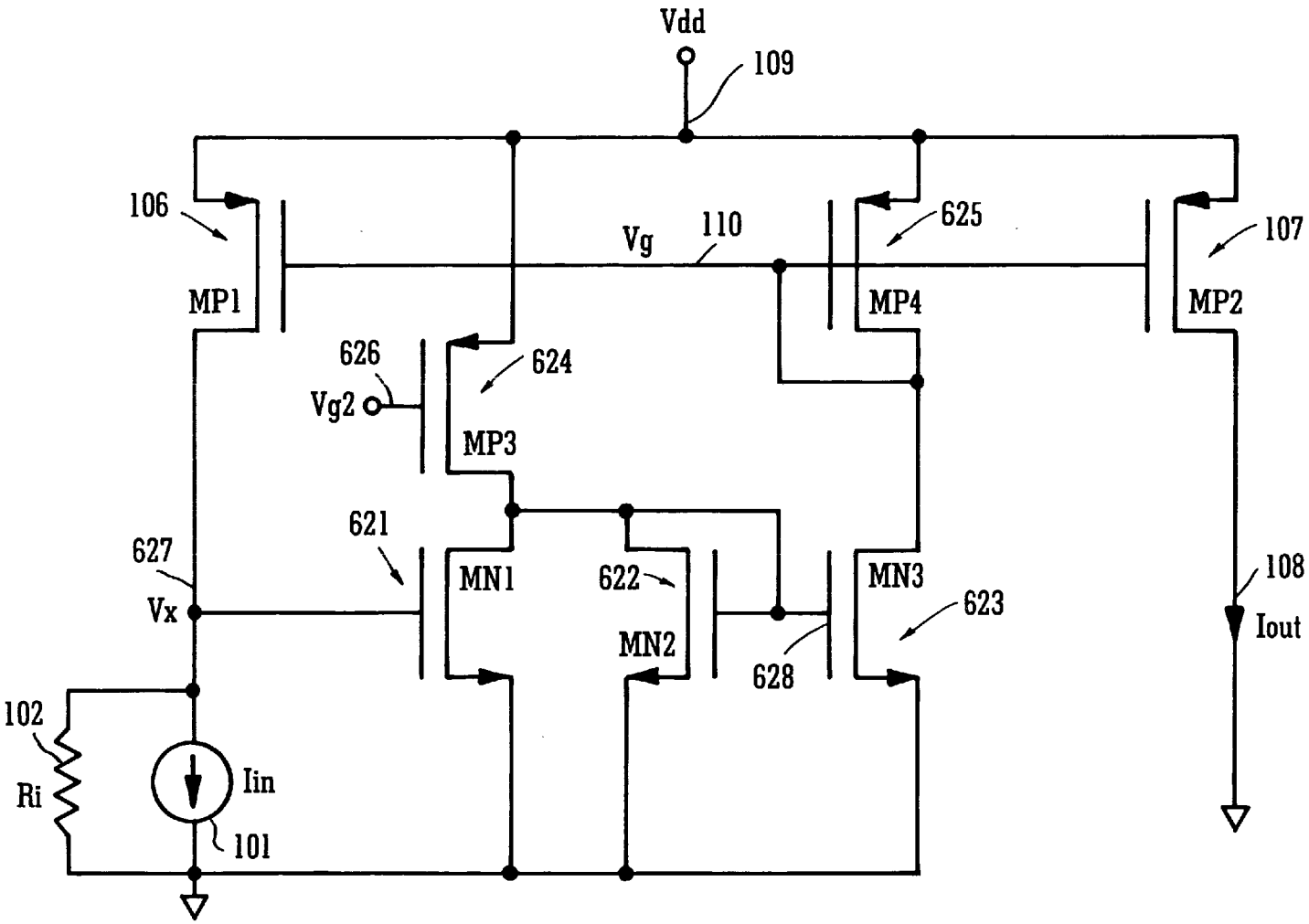
FIG. 6 illustrates the current mirror of FIG. 4 with the amplifier shown in its transistor implementation.

FIG. 6 illustrates a current mirror circuit in accordance with the present invention with the amplifier 414 of FIG. 5 implemented by transistors MN1, MN2, MN3, MP3, and MP4. This gives an amplifier with a gain close to unity, but its exact value is not important. The bias voltage Vg2 626 is set such that MP3 624 behaves like a current source. Vg2 626 is also established in such a way that Vg2 tracks any changes in $V_{DD}$ 109.

The amplifier is implemented in two stages. The input stage is made up of MN1 621, MN2 622, and MP3 624. This is a low gain inverting stage with a ground referenced input. As Vx 627 is increased, the current in MN1 621 increases. As MP3 624 is biased with a constant current, the current in MN2 622 must decrease as the current in MN1 621 increases. This causes the voltage at the gate 628 of MN3 623 to decrease.

The second stage comprises MN3 623 and MP4 625. This second stage is also a low gain inverting stage. As the gate voltage of MN3 623 is increased, the current in MN3 623 increases. This current flows in MP4 625, which increases its Vgs. The increase in Vgs causes Vg 110 to decrease. The output of the amplifier is thus referenced to $V_{DD}$, as noted above, since Vg tracks any changes in $V_{DD}$.

The circuit of FIG. 6 has improved power supply rejection over the circuit of FIG. 1, as noted previously. The circuit shown in FIG. 2 also outperforms the circuit of FIG. 1 as described above, principally through the use of cascoding. In fact, the circuit of FIG. 2 may actually approach the same power supply rejection as the circuit of FIG. 6 if the input current source were cascoded, but it is known in the art that this technique requires more headroom. For the circuit of FIG. 2 (with the input current source cascoded), the input stack of transistors requires that $V_{DD}$ be greater than $2^*Vd_{satN}+Vgs_P$, where $Vd_{satN}$ is the saturation drain voltage of the n-channel transistors, and $Vgs_P$ is the gate to source voltage of the p-channel transistors. The maximum voltage allowed at the drain of MP4 is $V_{DD}-2^*Vd_{satP}$. For the circuit of FIG. 6, $V_{DD}$ need only be greater than either $Vgs_N+Vd_{satP}$ or $Vgs_P+Vd_{satN}$. The maximum voltage allowed at the drain of MP2 is also greater at $V_{DD}-Vd_{satP}$.

Figure 7:
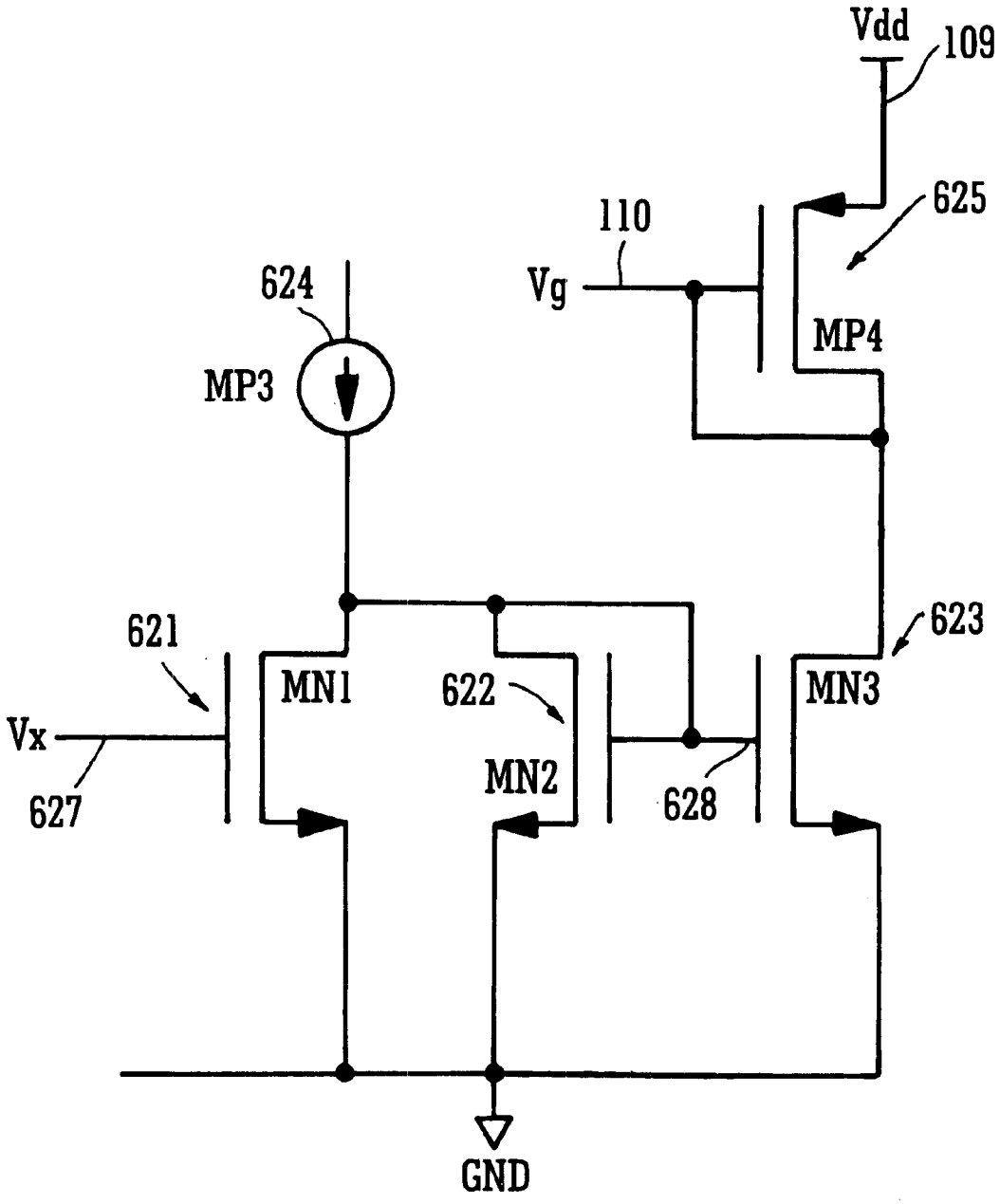
FIG. 7. is a simplified view of a portion of the current mirror of FIG. 6.

Of course, there can be offset voltages at both the input and output of the circuit of FIG. 6. FIG. 7 is a simplified view of a portion of FIG. 6 that better illustrates DC behaviour. As can be appreciated from an examination of FIG. 7, the input is single-ended, but still measured with respect to. ground. The range on Vg is less than $V_{DD}$.

When Vx 627 is at its maximum, MN1 621 takes all of the current from MP3 624, leaving no current flowing in MN2 622, MN3 623, or MP4 625. With no current in MP4 625, $Vg=V_{DD}$. As Vx decreases, current flows in MN2 622 and is mirrored to MP4 625 via MN3 623. This causes Vg to decrease until it reaches its minimum when Vx is zero.

A more correct relation that describes this operation is:

$$Vg-V_{DD}-(Vg_{MIN}-V_{DD})=A^*Vx$$

where $Vg_{MIN}-V_{DD}$ represents the offset. When Vx=0, $Vg=Vg_{MIN}$.

Figure 8:
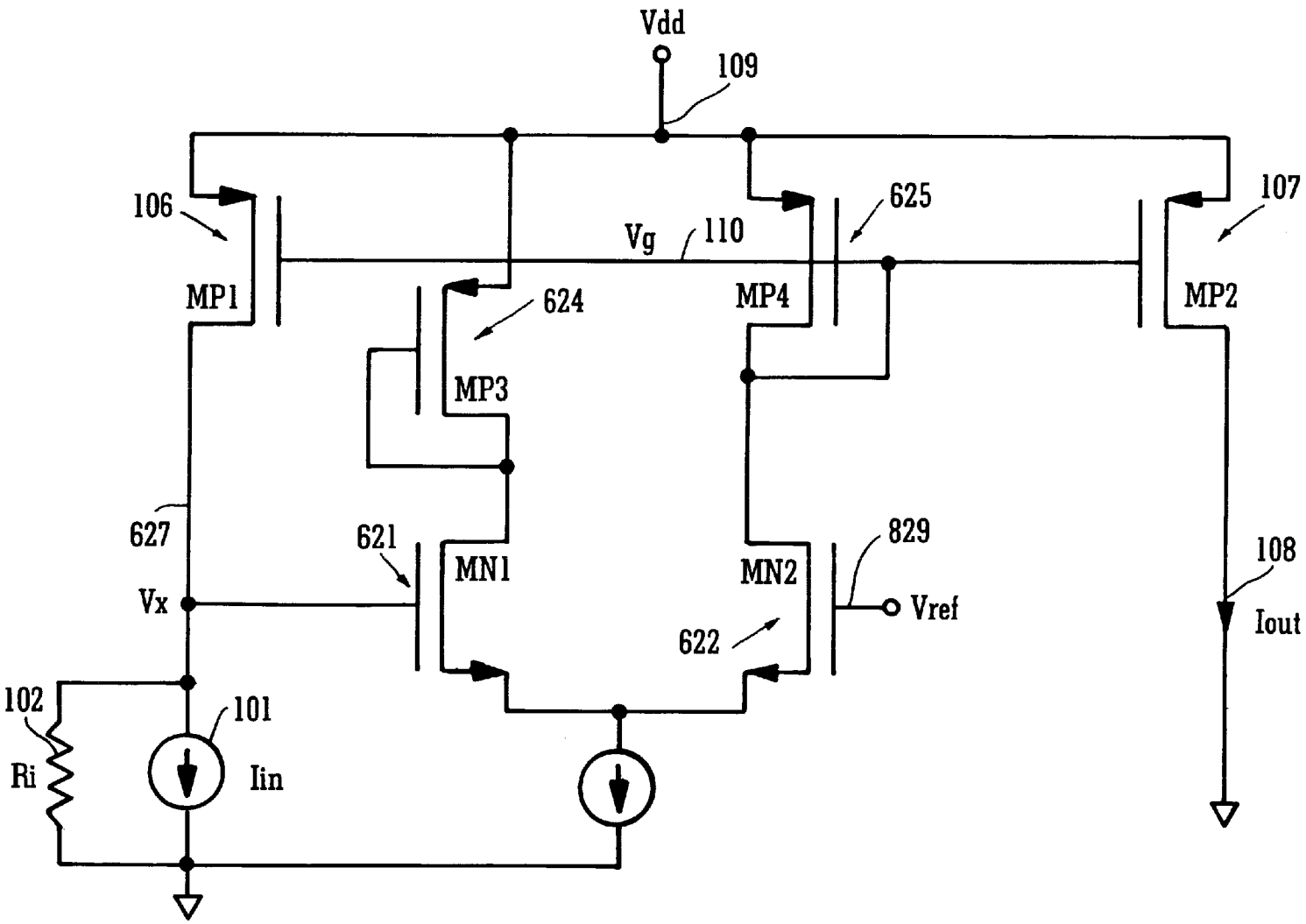
FIG. 8 depicts an alternative embodiment of a current mirror in accordance with the present invention.

The circuit of FIG. 8 is an alternative embodiment of a current mirror in accordance with the present invention. In the circuit of FIG. 8, the amplifier is implemented as a single stage differential amplifier. The amplifier is made up of MN1 621, MN2 622, MP3 624, and MP4 625. This amplifier requires a ground referred reference voltage, Vref 829. This reference voltage must have sufficient power supply rejection of its own, so that it is not permitted to overwhelm the power supply rejection of the current mirror itself. The circuit of FIG. 8 requires more headroom to implement than the circuit of FIG. 6.

The inventive concepts set forth herein can also be applied, for example, to improving the ground rejection of a current sink among other uses. These concepts should not be viewed as restricted to CMOS implementations. In fact, the concepts introduced herein can readily be applied in a complementary fashion, and can be extended to technologies other than MOS. It is also a characteristic of the present invention that the output leg of the current mirror, in any of its exemplary embodiments, may of course be replicated multiple times to provide a number of outputs, and each output will have the same improved PSRR.

It should be noted that the present invention, in its preferred form, provides improved power supply rejection without the headroom concerns associated with cascoded implementations. However, the technique disclosed herein may readily be applied to cascoded configurations in situations where headroom is not of particular consequence. In situations where current sources are made up of more than one transistor (i.e., cascoded current sources), these current sources may be characterized as current sources or transconductors with common control terminals, rather than simply as transistors, without loss of accuracy in description.

There has been described herein a current mirror having improved power supply rejection that offers distinct advantages when compared with the prior art. It will be apparent to those skilled in the art that modifications may be made without departing from the spirit and scope of the invention. Accordingly, it is not intended that the invention be limited except as may be necessary in view of the appended claims.

What is claimed is:

1. A circuit comprising:

a current source providing an input current;

first and second transistors having common control terminals and forming a current mirror connected between first and second power supply potentials, with said first transistor having an input coupled to said current source, said current mirror generating a mirror current at an output of said second transistor; and an amplifier connected in a negative feedback loop around said first transistor, wherein said amplifier input is referenced to the first power supply potential, and said amplifier output provides said control terminals with a voltage which varies with said second power supply potential.

2. The circuit of claim 1, wherein said first and second transistors are MOS transistors.

3. The circuit of claim 2, wherein said common control terminals of said first and second transistors comprise common source terminals and common gate terminals.

4. The circuit of claim 3, wherein said input current source is connected in series with said first transistor drain terminal, defining an amplifier input node therebetween.

5. The circuit of claim 4, wherein said amplifier output is coupled to said common gate terminals of said first and second transistors.

6. The circuit of claim 5, wherein said first supply potential is ground potential.

7. The circuit of claim 5, wherein said second supply potential is a positive power supply voltage, said second supply potential coupled to said common source terminals of said first and second transistors.

8. The circuit of claim 4, wherein said amplifier comprises:

an input stage including third and fourth transistors configured as a parallel transistor pair connected in series with a fifth transistor configured as a current source; and an output stage comprising a sixth transistor coupled to said input stage and in series with a diode-connected output transistor.

9. The circuit of claim 8, wherein the third and fourth transistors are MOS transistors.

10. The circuit of claim 9, wherein the amplifier input signal is applied to the gate terminal of said third transistor.

11. The circuit of claim 10, wherein the third and fourth transistors have common source terminals each coupled to said first power supply potential, and common drain terminals each coupled to said fifth transistor configured as a current source.

12. The circuit of claim 11, wherein a bias potential is applied to a gate terminal of said fifth transistor to establish fifth transistor operating current.

13. The circuit of claim 12, wherein said bias potential is derived from said second power supply potential such that variations in said second power supply potential appear in said bias potential.

14. The circuit of claim 13, wherein a gate terminal of said fourth transistor is coupled to said common drain terminals of said third and fourth transistors, said gate terminal defining both an output of said first amplifier stage and an input of said second amplifier stage.

15. The circuit of claim 14, wherein said sixth transistor further includes a source terminal coupled to said first power supply potential and a drain terminal coupled to common drain and gate terminals of said seventh diode-connected transistor.

16. The circuit of claim 15, wherein said seventh diode-connected transistor includes a source terminal coupled to said second power supply potential, and wherein said common drain and gate terminals are coupled to said common gate terminals shared by said first and second transistors of said current mirror.

17. The circuit of claim 4, wherein said amplifier comprises:

a single stage differential amplifier including third and fourth transistors configured as a differential transistor pair and sharing common source terminals;

a current source interposed between said common source terminals and said first power supply potential;

a fifth diode-connected transistor coupled between a drain terminal of said third transistor and said second power supply potential;

a sixth diode-connected transistor coupled between a drain terminal of said fourth transistor and said second power supply potential, said sixth transistor having gate and drain electrodes connected together and coupled to said common gate terminals of said first and second transistors.

18. A method for improving power supply rejection ratio of a current mirror including first and second transistors having common control terminals and forming a current mirror connected between first and second power supply potentials, with said first transistor having an input coupled to an input current source, and said current mirror generating a mirror current at an output of said second transistor, the method comprising the steps of:

(a) providing an amplifier in a negative feedback loop around said first transistor;

(b) configuring said amplifier such that said amplifier input is referenced to the first power supply potential; and (c) configuring said amplifier such that said amplifier output provides said control terminals with a voltage which varies with said second power supply potential;

wherein said negative feedback establishes a control voltage at one of said common control terminals to maintain substantial equality between said input current and said mirror current.

19. A circuit comprising:

a current source providing an input current;

first and second transconductors having common control terminals and forming a current mirror connected between first and second power supply potentials, with said first transconductor having an input coupled to said current source, said current mirror generating a mirror current at an output of said second transconductor; and an amplifier connected in a negative feedback loop around said first transconductor, wherein said amplifier input is referenced to the first power supply potential, and said amplifier output provides said control terminals with a voltage which varies with said second power supply potential.

20. The circuit of claim 19, wherein said transconductors comprise single transistors.

21. The circuit of claim 19, wherein said transconductors comprise cascoded transistors.

* * * * *